US008304699B2

(12) United States Patent
Fliess et al.

(10) Patent No.: US 8,304,699 B2
(45) Date of Patent: Nov. 6, 2012

(54) PROXIMITY SENSOR

(75) Inventors: Winston S. Fliess, Olathe, KS (US); Anitha Kalla, Olathe, KS (US)

(73) Assignee: BE Intellectual Property, Inc., Lenexa, KS (US)

( * ) Notice: Subject to any disclaimer, the term of this patent is extended or adjusted under 35 U.S.C. 154(b) by 1043 days.

(21) Appl. No.: 12/260,766

(22) Filed: Oct. 29, 2008

(65) Prior Publication Data

US 2010/0102050 A1 Apr. 29, 2010

(51) Int. Cl.
*H05B 1/02* (2006.01)

(52) U.S. Cl. ..... 219/509; 219/497; 219/492; 392/474

(58) Field of Classification Search ..... 219/494, 219/497, 506–511; 392/499
See application file for complete search history.

(56) References Cited

U.S. PATENT DOCUMENTS

| | | | | |
|---|---|---|---|---|
| 4,603,621 | A * | 8/1986 | Roberts | 99/307 |
| 4,978,833 | A | 12/1990 | Knepler | |
| 5,285,717 | A | 2/1994 | Knepler | |
| 5,868,311 | A * | 2/1999 | Cretu-Petra | 236/12.12 |
| 2007/0204925 | A1 * | 9/2007 | Bolderheij et al. | 137/801 |

* cited by examiner

*Primary Examiner* — Mark Paschall
(74) *Attorney, Agent, or Firm* — Fulwider Patton LLP

(57) ABSTRACT

A proximity switch flow sensor detects movement of a faucet handle of a faucet of a hot water container in order to detect flow from the hot water container. The proximity switch flow sensor includes an emitter paired with a detector, which can be mounted in association with the faucet handle to detect open and closed positions of the faucet handle, to provide electronic logic information regarding the status of the faucet handle position, as an indication of a flow condition, to a control unit that controls heating of water in the hot water container. An electro-mechanical switch and a mechanism to transfer movement of the faucet handle to the switch may also be used to detect open and closed positions of the faucet handle as an indication of a flow condition.

16 Claims, 5 Drawing Sheets

PROXIMITY SENSOR

BACKGROUND OF THE INVENTION

1. Field of the Invention

The present invention relates generally to the field of beverage makers, coffee makers, water heaters, and water boilers, and more particularly relates to a system for detecting flow in hot water containers such as in galley inserts on aircraft.

2. General Background and State-of-the-Art

Referring to FIG. 1, illustrating a prior art water boiler having a manual faucet or tap 10, operated manually by a handle 12 to dispense hot water from a water tank 14, certain water boilers, water heaters, coffee makers, or the like, hereafter referred to as "units," use such a manual faucet or tap to dispense hot water. In these units, the control circuitry that controls heating of the water does not initiate heating of the water as soon as water is being dispensed. These units' control circuits solely rely on detection of the temperature of the water in the tank to turn the heaters on and off. In these units, the heaters are turned on only when the detected water temperature inside the tank falls below a pre-set limit. As a result, the control circuitry cannot anticipate the need for heating the water. The drawback of this approach is that it creates a delay between the time when water is being withdrawn and when the heaters are turned on.

It would be desirable to provide a more reliable, less expensive and lighter system to detect flow from a water heater container, using a sensor to detect and convert physical movement of the faucet handle to an open or closed circuit. The present invention satisfies these and other needs.

SUMMARY OF THE INVENTION

Briefly, and in general terms, the present invention provides a system to detect flow through a faucet of a water heater container by using a sensor to detect and convert physical movement of a faucet handle to provide a signal indicating an open or closed circuit. For example, based upon signals from the sensor, an electronic control system logic may anticipate the need for water reheating when the faucet is opened by the user.

Accordingly, the present invention provides for a proximity switch flow sensor for detecting flow through a faucet of a water heater container. The proximity switch flow sensor includes a faucet handle mounted to the faucet of the water heater container, the faucet handle having a movable portion that is movable between an open position allowing flow through the faucet and a closed position preventing flow through the faucet, and a sensor cooperatively mounted in association with the movable portion of the faucet handle to detect movement of the movable portion of the faucet handle between the open position of the faucet handle and the closed position of the faucet handle. The sensor generates a faucet position signal indicating whether the movable portion of the faucet handle is in the open position or the closed position. As a result, the electronic control system logic may initiate reheating the water tank in response to the faucet position signal, so that the volume of hot water (above certain temperature) that can be drawn increases, and the recovery time required to heat the water in the tank is reduced. Conversely, the electronic control system logic may stop reheating the water tank if the user is not operating the faucet.

One useful, less expensive, and lighter type of sensor that is useful for detecting faucet handle positions is a proximity sensor, which can be used to detect and convert physical movement of the faucet handle to an open or closed circuit. A proximity sensor is defined herein as a sensor that can detect physical movement of a target object without touching the target, such as a combination of an emitter configured to emit a detectable field, such as an electromagnetic field or beam, or sound, and a detector configured to detect the detectable field, and to sense changes in the field.

Accordingly, in one presently preferred embodiment, the sensor can be a proximity sensor including an emitter configured to emit a detectable field, and a detector arranged in cooperation with the emitter such that the detector is operative to detect the detectable field when the faucet handle is in the closed position, and to not detect the detectable field when the faucet handle is in the open position. In another presently preferred aspect, the emitter and detector can be mounted adjacent to and in association with the faucet handle, such that the emitted detectable field from the emitter is reflected by an exterior surface of the movable portion of the faucet handle and is received by the detector when the movable portion of the faucet handle is in the closed position, and is not received by the detector when the movable portion of the faucet handle is in the open position.

In another aspect, the emitter can also be mounted to one of the movable portion of the faucet handle and a location adjacent to the movable portion of the faucet handle, and the detector can be mounted to the other of the movable portion of the faucet handle and the location adjacent to the faucet handle.

In presently preferred aspect, the emitter can be a light emitter, such as an infrared light emitter, for example, and the detector can be a photoelectric light sensor, such as an infrared light sensor, for example. In another aspect, the emitter can be a sound emitter, such as an ultrasonic sound emitter, for example, and the detector can be an acoustic proximity sensor, such as an ultrasonic sound proximity sensor, for example. In yet another aspect, the emitter can be a source of inductance, such as a target metal plate, and the detector can be an inductance sensor.

In a second presently preferred embodiment, a mechanism is provided for transferring movement of the movable portion of the faucet handle to a detector for detection of the movement of the movable portion of the faucet handle. The mechanism for transferring movement typically includes a mechanical linkage having opposing first and second ends, the first end being configured to engage the movable portion of the faucet handle, and the second end being configured to move between first and second positions corresponding to the open position of the faucet handle and the closed position of the faucet handle, respectively. The detector for detection of the movement of the movable portion of the faucet handle detects movement of the second end of the mechanical linkage between the first and second positions, and generates a faucet position signal indicating movement of the movable portion of the faucet handle between the open position of the faucet handle and the closed position of the faucet handle responsive to the movement of the second end of the mechanical linkage between the first and second positions. The mechanical linkage may include a spring-loaded travel rod biased to engage the movable portion of the faucet handle, for example, and the detector may be a motion sensor such as a make/break infrared sensor, or a micro-switch, for example.

In each of the first and second embodiment, an electronic control unit may also be provided that is configured to receive the faucet position signal to optimize heating of water inside the water heater container responsive to the faucet position signal. For example, the electronic control unit may be configured with a control logic operative to switch on a heating element in the water heater container as soon as the switch faucet position signal is received indicating flow through the faucet.

These and other aspects and advantages of the invention will become apparent from the following detailed description and the accompanying drawings, which illustrate by way of example the features of the invention.

DETAILED DESCRIPTION OF THE PREFERRED EMBODIMENTS

Figure 1:
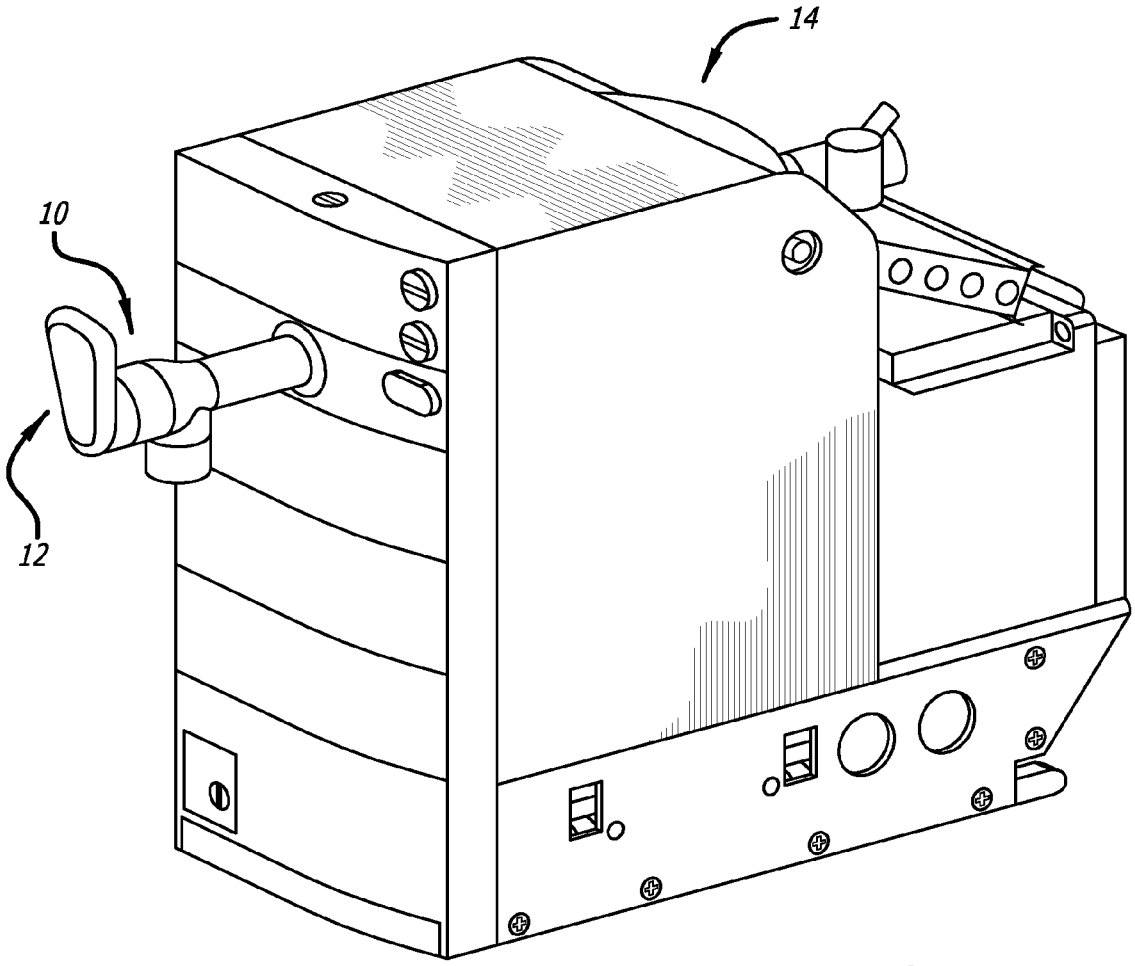
FIG. 1 (Prior Art)
FIG. 1 is a perspective view of a prior art water boiler.

Referring to the drawings, the present invention provides for a system to detect flow from a water heater container, involving the use of a sensor mounted in association with a faucet handle of the water heater container in order to detect movement of the faucet handle of the water heater container. An electrical signal of the sensor (open or closed) is used to provide the electronic logic information regarding the status of the faucet handle position (open or closed). This information is processed by the galley inserts electronics to optimize the reheating of the water inside the heating tank.

Figure 2A:
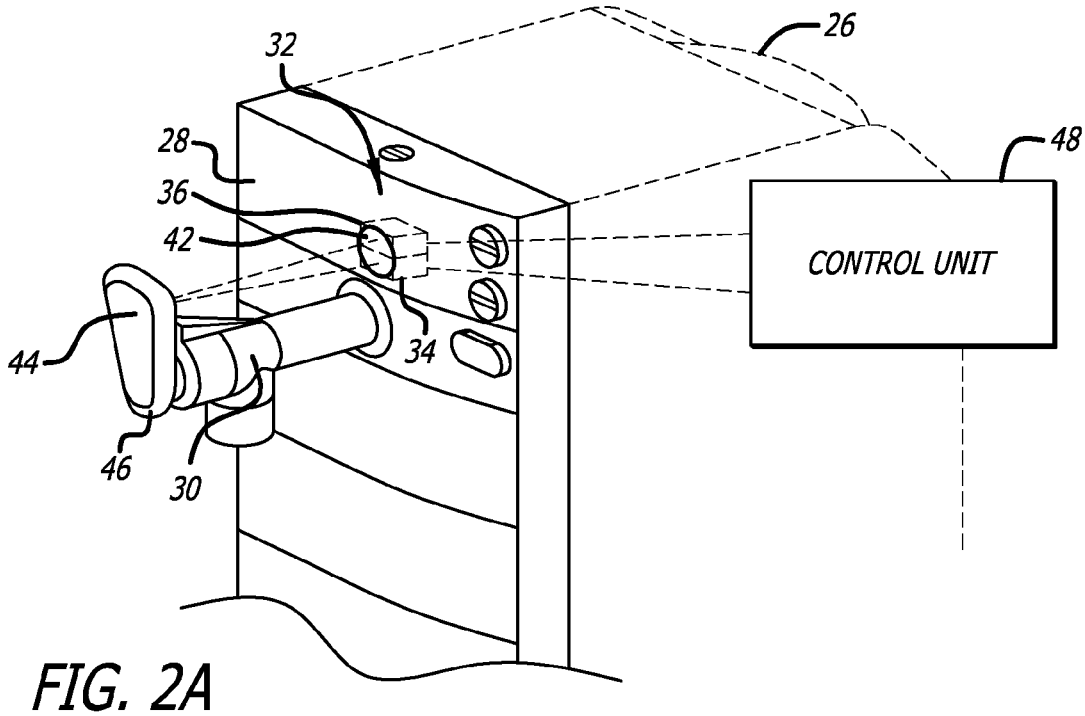
FIG. 2A is a schematic diagram of a first embodiment of a flow sensing apparatus utilizing a proximity sensor according to the present invention, showing a no-flow condition with the faucet in a closed position and the proximity sensor circuit in a closed configuration.*
Figure 2B:
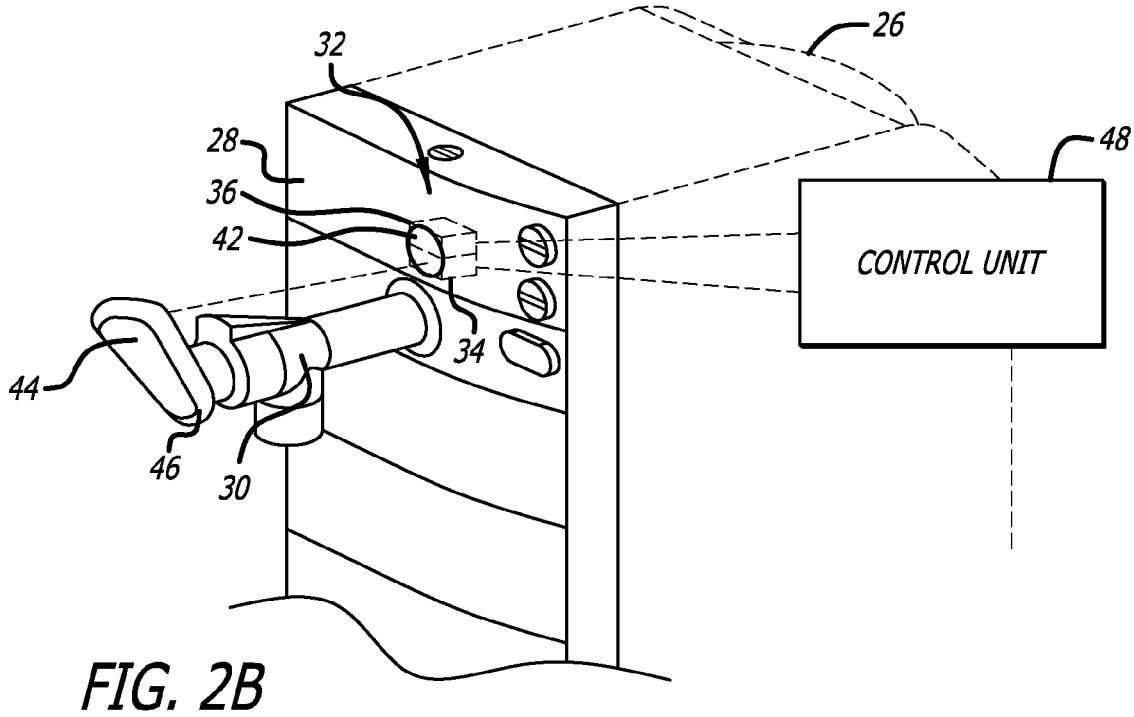
FIG. 2B is a schematic diagram similar to FIG. 2A, showing a flow condition with the faucet in an open position and the proximity sensor circuit in an open configuration.
Figure 3A:
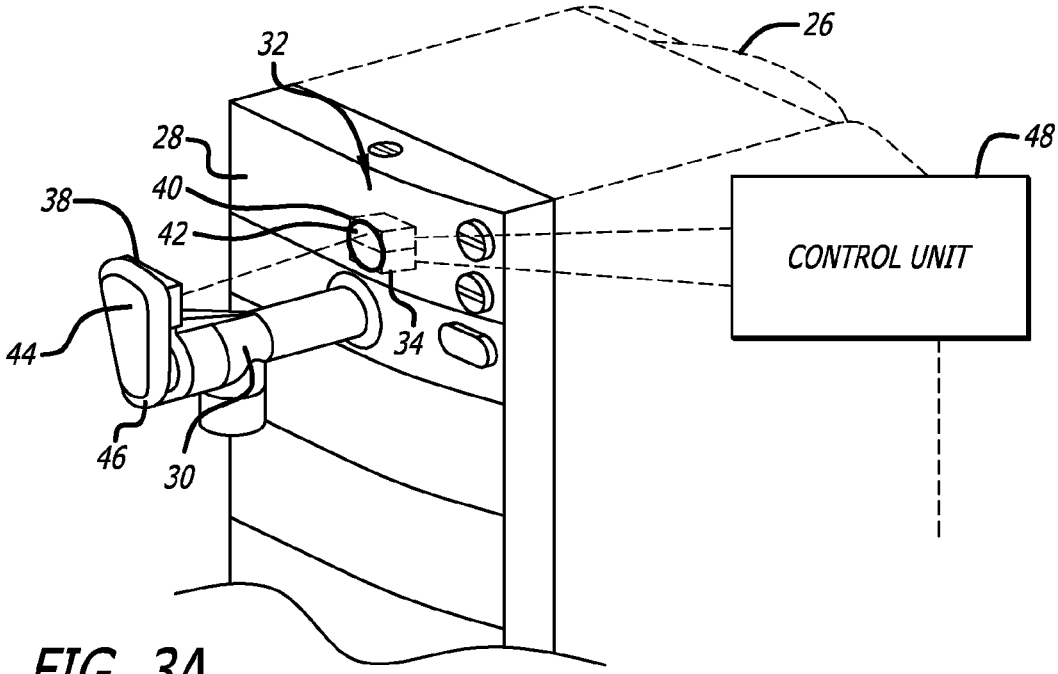
FIG. 3A is a schematic diagram of a variation of the embodiment FIG. 2A, utilizing an inductance proximity sensor, showing a no-flow condition with the faucet in a closed position and the proximity sensor circuit in a closed configuration.
Figure 3B:
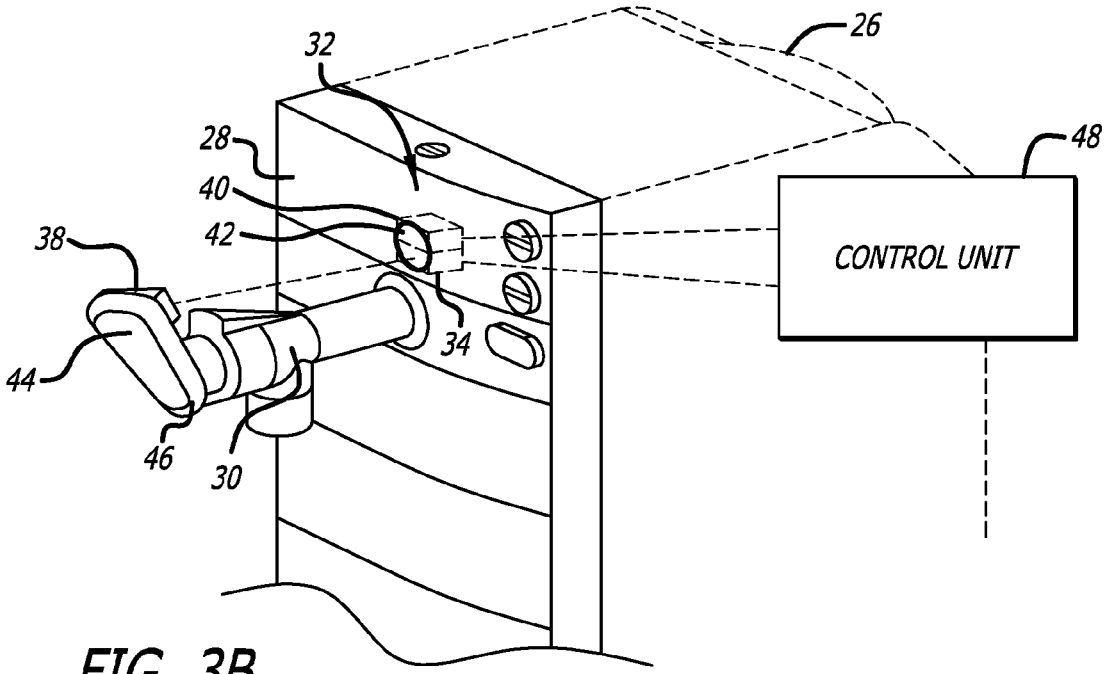
FIG. 3B is a schematic diagram similar to FIG. 3A, showing a flow condition with the faucet in an open position and the proximity sensor circuit in an open configuration.

Referring to FIGS. 2A and 2B, in the first preferred embodiment of the invention, a water boiler 26 similar to that of FIG. 1 can be constructed with a front panel 28 having a water faucet 30 with a proximity sensor 32 utilizing an emitter 34 that emits a detectable field, and a detector 36 to detect the detectable field and sense changes in the detectable field, to sense flow through the faucet, according to the present invention. In one presently preferred aspect, the proximity sensor can be an infrared light emitter, such as an LED, for example, paired in combination with a photoelectric infrared light sensor for sensing a beam of infrared light from the emitter. Alternatively, the proximity sensor can be a combination of another type of light emitter, paired with a corresponding photoelectric light sensor; an ultrasonic sound emitter, paired with a corresponding ultrasonic sound proximity sensor; or another type of sound emitter, paired with a corresponding acoustic proximity sensor; or as is illustrated in FIGS. 3A and 3B, a source of inductance, such as a target metal plate 38, for example, paired with a corresponding inductance sensor 40. Other types of combinations of an emitter of a detectable field and a detector of the detectable field may also be suitable.

The emitter and detector are typically mounted behind the front panel, typically behind a window 42, for example, which may include an appropriate filter, such as an infrared filter, for example, when an infrared photoelectric proximity sensor is used. The paired emitter and detector are able to detect objects in near proximity to the paired emitter and detector. When an infrared photoelectric proximity sensor is used, for example, the proximity sensor is located behind the faucet handle such that the emitted infrared beam from the emitter is reflected by the opposing exterior surface of a movable portion 44 of the faucet handle 46, and is received by the detector, when the faucet handle is in the upright, closed position. When an operator pulls the faucet handle to draw water from the water boiler, the reflecting opposing exterior surface of the faucet handle is pulled away, so that the emitted infrared beam from the emitter is not reflected back to the detector, causing the detector to generate an electrical signal indicating the position of the faucet handle is open.

The proximity sensor could alternatively be mounted with the emitter mounted to one of the movable portion of the faucet handle and a location adjacent to the movable portion of the faucet handle, such as behind the front panel for example, with the detector mounted to the other of the movable portion of the faucet handle and the location adjacent to the faucet handle, to receive the emitted detectable field directly from the emitter when the emitter is in the upright position, indicating a closed position of the faucet handle and indicating a no-flow condition, such as when the emitter is a source of an inductance field and the detector is an inductance detector. Thus, when the faucet handle is moved from the closed position, shown in FIGS. 2A and 3A, to the open position, shown in FIGS. 2B and 3B, to draw water from the water boiler, the emitted detectable field is not detected by the detector, causing the detector to generate an electrical signal indicating the position of the faucet handle is open, indicating a flow condition, signaling withdrawal of water from the tank.

The proximity sensor can be connected to an electronic control unit 48, such as a PC board, for example, that can be configured with a control logic to switch on the heating elements in a water heater or water boiler as soon as the switch signal indicating withdrawal of water from the tank is detected, thus improving the recovery time. The proximity switch is non-obtrusive and is substantially hidden when installed, and does not adversely impact the appearance or operation of the faucet or the handle. The use of a proximity sensor to sense the flow through the faucet of a water heater container by sensing mechanical movement of the faucet handle easily accomplishes sensing of flow from the faucet of a water heater container at reduced cost, reduced weight, and improved reliability compared to conventional systems.

Figure 4A:
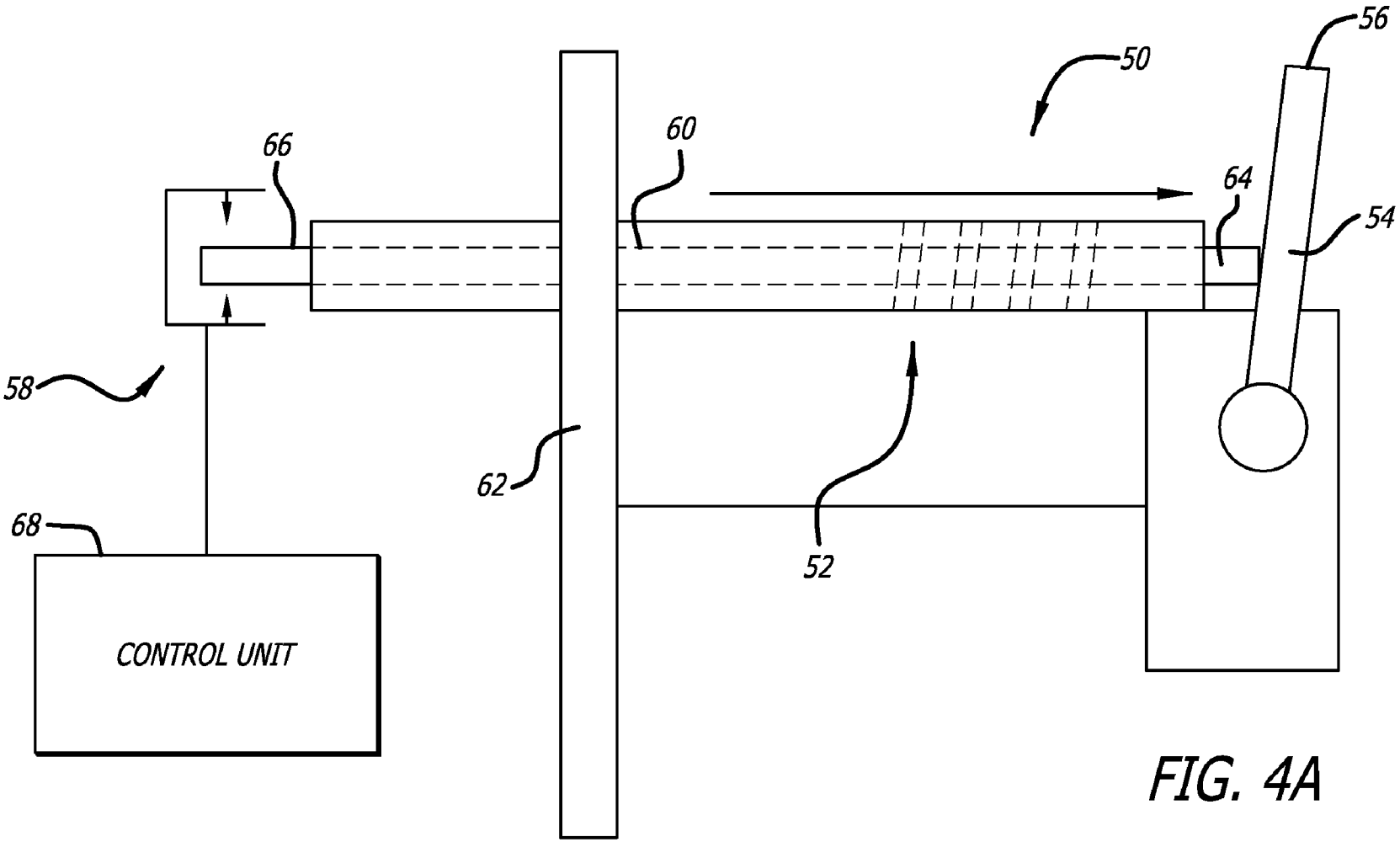
FIG. 4A is a schematic diagram of a prior art an electro-mechanical flow sensing apparatus, showing a no-flow condition with the faucet in a closed position and the electro-mechanical flow sensing apparatus in a closed configuration.
Figure 4B:
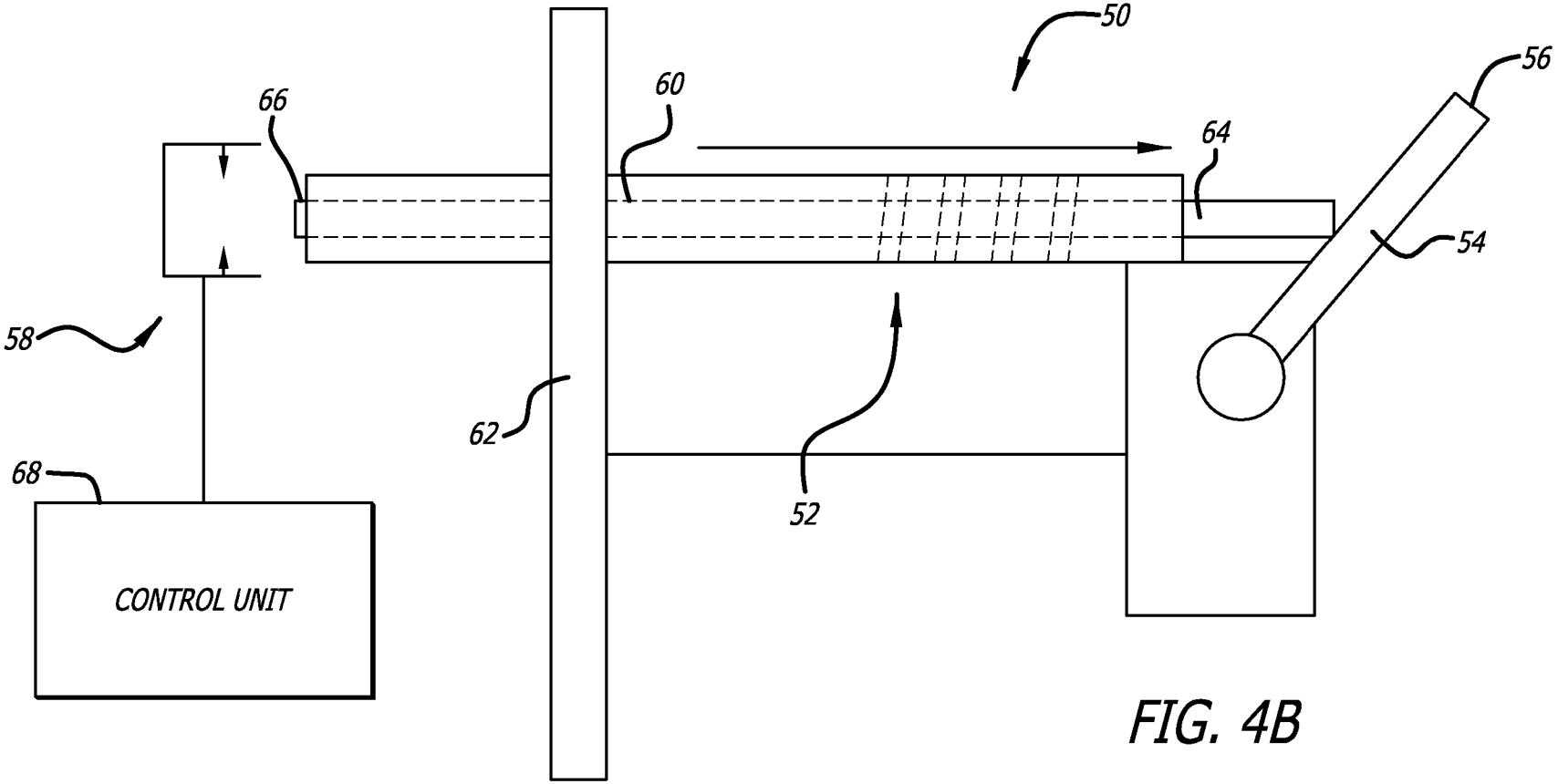
FIG. 4B is a schematic diagram similar to FIG. 4A, showing a flow condition with the faucet in an open position and the electro-mechanical flow sensing apparatus in an open configuration.

Referring to FIGS. 4A and 4B, flow through a faucet of a water boiler or water heater can be detected by electro-mechanically monitoring the physical location of the outlet faucet handle, such as by a prior art electro-mechanical flow sensing apparatus 50, including a mechanism 52 to transfer the movement of a movable portion 54 of a faucet handle 56 of a water faucet (not shown), such as is illustrated in FIGS. 1, 2A, 2B, 3A, and 3B to a detector 58. As is illustrated in FIGS. 4A and 4B, a spring-loaded travel rod 60 can be mounted to a portion 62 of the water faucet or other suitable portion of a water boiler or water heater (not shown). A first end 64 of the spring-loaded travel rod can be mounted adjacent to and biased to remain in contact with the faucet handle, so that movement of the movable portion of the faucet handle from a first closed position, shown in FIG. 4A, to a second open position, shown in FIG. 4B, correspondingly moves an opposing second end 66 of the spring-loaded travel rod longitudinally between a first closed position, illustrated in FIG. 4A, and a second open position, illustrated in FIG. 4B, respectively. The detector, which may be a motion sensor such as a make/break infrared sensor, or a micro-switch, for example, can be mounted adjacent to the spring-loaded travel rod to detect the position of the second end of the spring-loaded travel rod, and communicates a signal to an electronic control unit 68 indicating whether the faucet handle is in the first or closed position, illustrated in FIG. 4A, or the second or open position, illustrated in FIG. 4B. The mechanical switch could be installed at the end of the faucet, directly in contact with the faucet handle, for example.

It will be apparent from the foregoing that while particular forms of the invention have been illustrated and described, various modifications can be made without departing from the spirit and scope of the invention.

The invention claimed is:

1. A proximity switch flow sensor for detecting flow through a faucet of a water heater container, the proximity switch flow sensor comprising:

a faucet handle mounted to the faucet of the water heater container, said faucet handle having a movable portion that is movable between an open position allowing flow through the faucet and a closed position preventing flow through the faucet; and a sensor cooperatively mounted in association with said movable portion of said faucet handle to detect movement of said movable portion of said faucet handle between said open position of the faucet handle and said closed position of the faucet handle, said sensor generating a faucet position signal indicating whether said movable portion of said faucet handle is in said open position of the faucet handle or said closed position of the faucet handle.

2. The proximity switch flow sensor of claim 1, wherein said sensor comprises a proximity sensor including an emitter configured to emit a detectable field, and a detector arranged in cooperation with said emitter, said detector detecting said detectable field when said faucet handle is in said closed position, and said detector not detecting said detectable field when said faucet handle is in said open position.

3. The proximity switch flow sensor of claim 1, wherein said emitter and detector are mounted adjacent to and in association with the faucet handle, such that the emitted detectable field from the emitter is reflected by an exterior surface of said movable portion of said faucet handle and is received by the detector when said movable portion of said faucet handle is in said closed position, and is not received by the detector when said movable portion of said faucet handle is in said open position.

4. The proximity switch flow sensor of claim 1, wherein said emitter is mounted to one of the movable portion of the faucet handle and a location adjacent to the movable portion of the faucet handle, said detector is mounted to the other of the movable portion of the faucet handle and the location adjacent to the faucet handle.

5. The proximity switch flow sensor of claim 1, wherein said emitter is a light emitter, and said detector is a light sensor.

6. The proximity switch flow sensor of claim 1, wherein said emitter is an infrared light emitter and said detector is an infrared light sensor.

7. The proximity switch flow sensor of claim 2, wherein said emitter is a sound emitter and said detector is an acoustic proximity sensor.

8. The proximity switch flow sensor of claim 7, wherein said sound emitter comprises an ultrasonic sound emitter and said detector is an ultrasonic sound proximity sensor.

9. The proximity switch flow sensor of claim 2, wherein said emitter is a source of inductance, and said detector is an inductance sensor.

10. The proximity switch flow sensor of claim 9, wherein said source of inductance comprises a target metal plate.

11. The proximity switch flow sensor of claim 2, wherein said emitter is mounted to said movable portion of said faucet handle.

12. The proximity switch flow sensor of claim 2, wherein said detector is mounted to said movable portion of the water faucet.

13. The flow sensing apparatus of claim 1, further comprising:

an electronic control unit configured to receive said faucet position signal to optimize heating of water inside the water heater container responsive to said faucet position signal.

14. The flow sensing apparatus of claim 13, wherein said electronic control unit is configured with a control logic operative to switch on a heating element in the water heater container as soon as the switch faucet position signal is received by said electronic control unit indicating flow through the faucet.

15. A proximity switch flow sensor for detecting flow through a faucet of a water heater container, the proximity switch flow sensor comprising:

a faucet handle mounted to the faucet of the water heater container, said faucet handle having a movable portion that is movable between an open position allowing flow through the faucet and a closed position preventing flow through the faucet; and a proximity sensor including a sound emitter configured to emit a detectable field and an acoustic proximity detector arranged in cooperation with said sound emitter, said acoustic proximity detector being configured to detect said detectable field when said faucet handle is in said closed position, and said acoustic proximity detector being configured to not detect said detectable field when said faucet handle is in said open position, said proximity sensor being cooperatively mounted in association with said movable portion of said faucet handle to detect movement of said movable portion of said faucet handle between said open position of the faucet handle and said closed position of the faucet handle, said proximity sensor generating a faucet position signal indicating whether said movable portion of said faucet handle is in said open position of the faucet handle or said closed position of the faucet handle.

16. The proximity switch flow sensor of claim 15, wherein said sound emitter comprises an ultrasonic sound emitter and said acoustic proximity detector is an ultrasonic sound proximity sensor.

* * * * *